US011198970B2

(12) United States Patent
Feng et al.

(10) Patent No.: US 11,198,970 B2
(45) Date of Patent: Dec. 14, 2021

(54) DYE COMPOSITION AND DYEING METHOD FOR ELASTIC FABRIC

(71) Applicant: TEX TILE ENTERPRISE CO., LTD., Taoyuan (TW)

(72) Inventors: Ko-Chun Feng, Taichung (TW); Kuo-Peng Huang, New Taipei (TW)

(73) Assignee: TEX TILE ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 16/749,473

(22) Filed: Jan. 22, 2020

(65) Prior Publication Data

US 2020/0370240 A1 Nov. 26, 2020

(30) Foreign Application Priority Data

May 24, 2019 (TW) ..... 108118003

(51) Int. Cl.

| | |
|---|---|
| ***D06P 1/38*** | (2006.01) |
| ***D06P 1/00*** | (2006.01) |
| ***D01F 6/72*** | (2006.01) |
| ***D01F 6/96*** | (2006.01) |
| ***D01F 6/70*** | (2006.01) |
| ***D06P 1/14*** | (2006.01) |

(52) U.S. Cl.

CPC ..... *D06P 1/38* (2013.01); *D01F 6/70* (2013.01); *D01F 6/72* (2013.01); *D01F 6/96* (2013.01); *D06P 1/0004* (2013.01); *D06P 1/14* (2013.01)

(58) Field of Classification Search

CPC .. D06P 1/38; D06P 1/0004; D06P 1/14; D01F 6/70; D01F 6/72; D01F 6/96

See application file for complete search history.

(56) References Cited

U.S. PATENT DOCUMENTS

| | | | | |
|---|---|---|---|---|
| 5,230,709 | A * | 7/1993 | Holfeld | D06P 1/0004 8/400 |
| 5,500,025 | A * | 3/1996 | Sharma | D06P 1/0032 8/685 |
| 2015/0299942 | A1* | 10/2015 | Hong | C08L 75/04 442/59 |
| 2016/0060809 | A1* | 3/2016 | Hines | D06P 1/0012 428/219 |

FOREIGN PATENT DOCUMENTS

| | | | | |
|---|---|---|---|---|
| CN | 104762839 | * | 7/2015 | D06P 3/87 |

OTHER PUBLICATIONS

Acid Black 194, http://www.worlddyevariety.com/acid-dyes/acid-black-194.html, Aug. 30, 2020.*

Acid Green 28, http://www.worlddyevariety.com/acid-dyes/acid-green-28.html, Feb. 26, 2021.*

* cited by examiner

*Primary Examiner* — Amina S Khan

(74) *Attorney, Agent, or Firm* — Li & Cai Intellectual Property (USA) Office

(57) ABSTRACT

A dye composition and a dyeing method for an elastic fabric are provided. The dyeing method includes: (a) providing an elastic fabric which includes an elastic fiber; and (b) immersing the elastic fabric in a dye composition. The dye composition includes an ion modifier and a dye. The elastic fiber of the elastic fabric has a first ion by contacting the ion modifier, and the first ion has a first charge; the dye has a second ion, and the second ion has a second charge opposite to the first charge. The first ion of the elastic fiber and the second ion of the dye together form an ionic bonding.

7 Claims, 3 Drawing Sheets

DYE COMPOSITION AND DYEING METHOD FOR ELASTIC FABRIC

CROSS-REFERENCE TO RELATED PATENT APPLICATION

This application claims the benefit of priority to Taiwan Patent Application No. 108118003, filed on May 24, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a dye composition and a dyeing method, and more particularly to a dye composition and a dyeing method for elastic fabrics.

BACKGROUND OF THE DISCLOSURE

Close-fitting and comfortable elastic fabric has become a must in fashion-wear and sportswear, such that the properties requirements such as tensile strength, resistances to washing, sun and rubbing of the elastic fabric have increased. Elastic fabric is generally called "OP" and is woven from elastic fiber and general fiber. It has strong elasticity, can reach 500% stretch, and return to its original shape after stretching, furthermore, the strength of elastic fabric is greater than rubber and is provided with excellent wear resistance.

However, conventional dyeing method cannot uniformly dye the elastic fiber when the fabric contains the elastic fiber, the dye would make the color unevenly distributed, causing the elastic fabric to be mix dyed, which results in low resistance to washing. The elastic fabric also has problems such as unevenly distributed color and serious chromatic aberration. These problems become serious when the elastic fiber content is increased. Therefore, in order to overcome the dyeing and finishing defects on the elastic fabric, it is long desired in the technical field to provide an effective dyeing method.

SUMMARY OF THE DISCLOSURE

In response to the above-referenced technical inadequacies, the present disclosure provides a dye composition and a dyeing method for solving issues of the related art, such as unevenly distributed color and serious chromatic aberration of elastic fabric after dyeing.

In one aspect, the present disclosure provides a dyeing method for an elastic fabric, including: (a) providing an elastic fabric including an elastic fiber; and (b) immersing the elastic fabric in a dye composition, the dye composition including an ion modifier and a dye, so that the elastic fiber of the elastic fabric contacts with the ion modifier and the dye, wherein, the elastic fiber has a first ion by contacting the ion modifier, the first ion has a first charge, the dye has a second ion, the second ion has a second charge opposite to the first charge, and the first ion of the elastic fiber and the second ion of the dye together form an ionic bonding to obtain a dyed elastic fabric.

In one aspect, the present disclosure provides a dye composition for an elastic fabric, including: an ion modifier, a dye and an additive. The ion modifier includes an ionizable terminal group; the dye includes a compound represented by the following chemical formula: A-B, wherein, A is selected from the group consisting of: monoazo dye, polyazo dye, metal complex monoazo dye, metal complex disazo dye, anthraquinone dye, naphthoquinone dye, pyrenequinone dye, triphenylmethane dye, xanthene dye, metal phthalocyanine dye, stilbene dye, nitroso dye, oxazine dye, dioxazine dye, pyrazolone dye and a combination thereof; wherein, B is selected from the group consisting of: OH group, $SO_3H$ group, $SO_3Na$ group, and COOH group, and a combination thereof.

Therefore, one of the beneficial effects of the present disclosure is that the dyeing method and the dye composition for an elastic fabric provided by the present disclosure has technical features of "the elastic fiber has a first ion by contacting the ion modifier" and "the first ion of the elastic fiber and the second ion of the dye together form an iconic bonding", so that, the first charge ion of the elastic fiber and the second ion of the dye produce a strong ionic bond with strong bonding force. The first ion of the elastic fiber and the second ion of the dye together form an iconic bonding. Thereby, the present disclosure improves the way of dyeing elastic fiber, which alleviates the barrie and stripe caused by traditional way of polluting elastic fiber. It also ensures Color Fastness to Water, Color Fastness to Washing, Color Fastness to Perspiration and Color Fastness to Rubbing at an optimal level.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
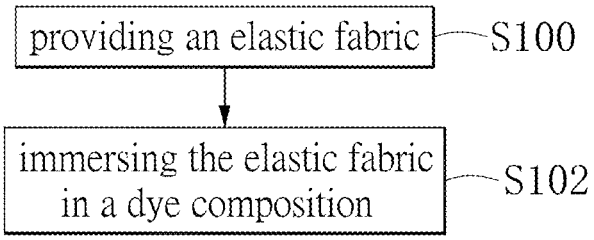
FIG. 1 is a flowchart of a dyeing method for an elastic fabric of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1, which is a flowchart of a dyeing method for an elastic fabric of the present disclosure, the dyeing method includes: (a) providing an elastic fabric that includes an elastic fiber (step S100); and (b) immersing the elastic fabric in a dye composition (step S102).

Generally, in step S100, the elastic fabric preferably includes 20 to 60 wt. % of elastic fiber. For example, the elastic fiber is at least one selected from the group consisting of Spandex, Lycra, natural rubber, and synthetic rubber, or it can be a mix of multiple elastic fibers. Furthermore, the elastic fabric may include non-elastic fibers according to practical requirements. For example, non-elastic fibers can be cotton, hemp, polyester, and nylon, but the present disclosure is not limited thereto. Pre-treatment can be performed according to properties of the elastic fabric or product requirements before dyeing the fabric. For example, the fabric can be washed first to remove impurities and paste, the elastic fabric may be impregnated with a pretreatment agent, and then washed with water to thoroughly remove the oil or other additives added during the manufacture of the fabric.

Next, in step S102, the elastic fabric is immersed in a dye composition, so that the elastic fiber of the elastic fabric contacts with an ion modifier and a dye so as to obtain a dyed elastic fabric. The dye composition of the present disclosure includes the ion modifier and the dye, wherein the elastic fiber has a first charge by contacting the ion modifier, the first ion has a first charge, while the dye has a second ion, and the second ion has a second charge opposite to the first charge. More specifically, the first ion is a positive charge, and the second charge is a negative charge; or, the first ion is a negative charge, and the second charge is a positive charge. Furthermore, the first charge of the elastic fiber and the second ion of the dye form a strong ionic bond by the attraction of electromagnetic forces of the two oppositely charged ions.

Figure 2:
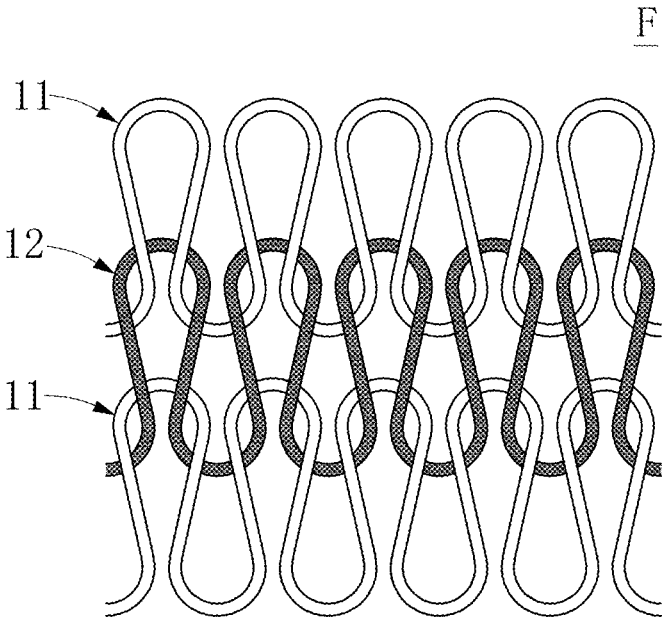
FIG. 2 is a schematic view of one of an elastic fabric of an embodiment of the present disclosure.
Figure 3:
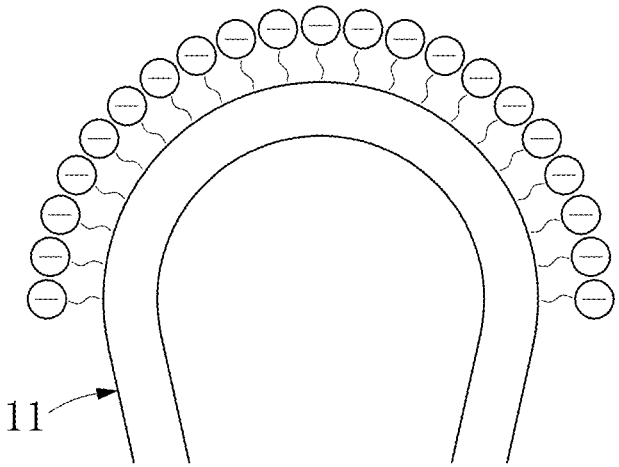
FIG. 3 is a schematic view of the dyeing method for an elastic fabric of an embodiment of the present disclosure.
Figure 4:
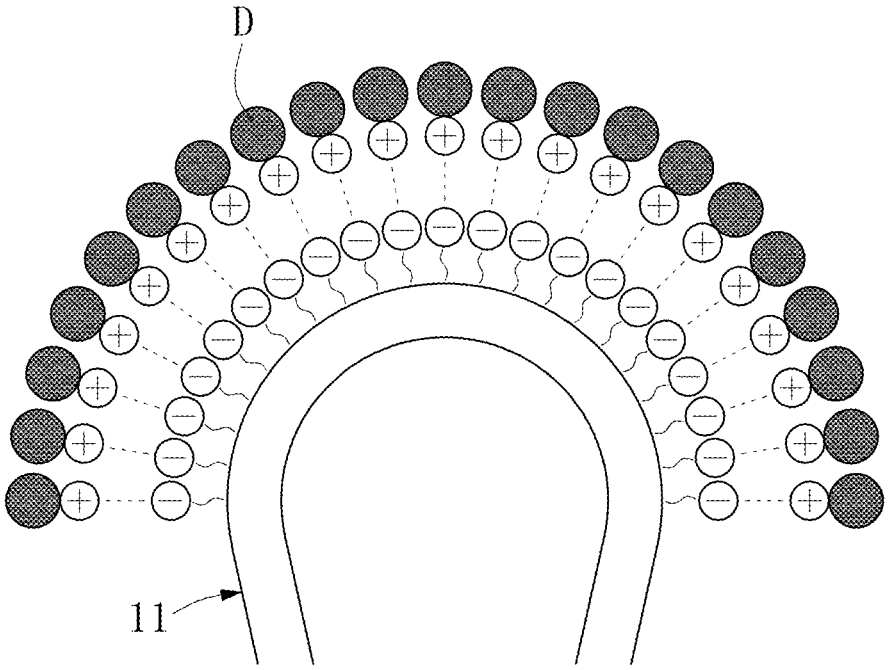
FIG. 4 is another schematic view of the dyeing method for an elastic fabric of an embodiment of the present disclosure.

Referring to FIG. 2 to FIG. 4, FIG. 2 is a schematic view of one of an elastic fabric of an embodiment of the present disclosure. As shown in FIG. 2, the elastic fabric F is made of an elastic fiber 11 and a non-elastic fiber 12 interlaced with each other, the knit structure and weave depend on requirements for the elastic fabric, and the present disclosure is not limited thereto. FIG. 3 and FIG. 4 are schematic views of the dyeing method for an elastic fabric of an embodiment of the present disclosure. As shown in FIG. 3, the elastic fiber 11 of the present disclosure produces a first ion by contacting the ion modifier (indicated by the charges carried by the ions in the figure). For example, the negative charge carried by the first ion is located on a surface of the elastic fiber 11, so that the surface of the elastic fiber 11 is electric. FIG. 4 shows an ionic bond being produced by a positive charge of a dye D attracted by the negative charge on the surface of the elastic fiber 11.

Specifically, in step S102, firstly a dye composition having an ion modifier and a dye may be formulated. In the dye composition, the ion modifier is in an amount of from 0.1 to 1.0 wt. % of the weight of the elastic fabric.

More specifically, in the dye composition, the ion modifier includes an ionizable terminal group. The ionizable terminal group is an ion group that can form an ionic group in a medium. For example, an anionic free radical can form an anion, and a cationic free radical can form a cation. More specifically, an anionic group such as $—COO^-$, $—SO^{3-}$, $—OSO^{3-}$, $—HPO^{3-}$, $—OPO_3^{2-}$, $—PO_3^{2-}$, and a cationic group such as quaternary ammonium ($—NR^{3+}$) and quaternary fluorenyl($—PR^{3+}$). R represents hydrogen or a substituted or unsubstituted aryl group or a substituted or unsubstituted alkyl group. The dye D includes a compound represented by the following chemical formula: A-B, wherein, A is selected from the group consisting of: monoazo dye, polyazo dye, metal complex monoazo dye, metal complex disazo dye, anthraquinone dye, naphthoquinone dye, pyrenequinone dye, triphenylmethane dye, xanthene dye, metal phthalocyanine dye, stilbene dye, nitroso dye, oxazine dye, dioxazine dye, pyrazolone dye and a combination thereof; wherein, B is selected from the group consisting of: OH group, $SO_3H$ group, $SO_3Na$ group, and COOH group, and a combination thereof. For example, the dissociation of group B in solution provides the dye D with a negative charge to attract the positive charge on the surface of the elastic fiber. Alternatively, the B group is dissociated in solution to provide the dye D with a positive charge to attract the negative charge on the surface of the elastic fiber.

In addition, the dye composition may further include a surfactant, a fixing agent, and a uniform agent as an additive, or alternatively further including at least one of the following: a dispersing agent, a fixing agent, an uniform agent, an emulsifier, a penetrant, an oxidizing agent, an antifoaming agent, a softening agent, a flame retardant, an electrostatic charge preventive agent, a water proofing agent, and an anti-mold agent.

The dispersing agent can be a nonionic or anionic dispersing agent. For example, the nonionic dispersing agent may be ethylene oxide or propylene oxide. The anionic dispersing agent may be a lignin sulfonate (ester) type, an alkyl- or alkylaryl sulfonate (ester) type or an alkylaryl polyglycol ether sulfate (ester) type. The surfactant may be, for example, an amphoteric surfactant, a polymer interface active compound or a mixture thereof. For example, butyl diglycol or 1,2-hexane diol may be used as a surfactant.

The dye composition of the present disclosure may further include a solvent, and a suitable solvent may be selected from the group consisting of water, alcohols, ethers, ketones, and ketols. For example, alcohols such as methanol, ethanol, n-propanol, isopropanol, n-butanol, 2-butanol, 3-butanol, isobutanol, polyethylene glycol, polypropylene glycol, ethylene glycol, propylene glycol, butylene glycol, triethylene glycol, thiodiethylene glycol, hexanediol and diethylene glycol, and other polyols such as glycerin or 1,2,6-hexanetriol; ethers such as tetrahydrofuran or dioxane; ketone or keto alcohol such as acetone or diacetone alcohol. An amount of solvent added can be adjusted according to practical requirements.

In addition, the dye composition has a pH value from pH 4 to pH 6. Impregnation conditions in the step (b), in which the elastic fabric is immersed in the dye composition, can include heating the dye composition from room temperature to a dyeing temperature of 85 to 115° C. by a heating rate of 0.5 to 1.5° C./min, and maintain the dyeing temperature for 20 to 60 minutes; and then cooling the dye composition from the dyeing temperature to a temperature between 70 to 60° C. by a cooling rate of 1 to 1.5° C./min.

Further, the method optionally includes step (c): washing the dyed elastic fabric for 3 to 5 minutes at a temperature between 45 to 50° C.

Embodiment 1

1. Fabric: an elastic fabric containing 43 wt. % of elastic fiber is prepared, and the dye composition is then prepared.
2. Dye composition: a dye LANASYN Turquoise M-5G is dissolved in water in a dyeing machine, adjust to a concentration of 0.5 wt. %, and add 0.15 wt. % of ion modifier, 0.5 wt. % of retarder, adjust the dye composition to pH 4 with an acetic acid.
3. Temperature curve: an initial temperature of the dye composition is room temperature, the dye composition is heated to a dyeing temperature of 85 to 115° C. by a heating rate of 0.5 to 1.0° C./min, and the elastic fabric is immersed in the dyeing machine for 20 to 60 minutes. The dye composition is then cooled to a temperature from 70 to 60° C. by a cooling rate of 1 to 1.5° C./min.
4. Water wash: the dyed elastic fabric is washed with water to remove excess dye for about 3 minutes, preferably until no pigment visible to the naked eye dissolves.
5. Color fix: 2.0-3.0% of fixing agent is added to the dye composition, adjust the dye composition to pH 4 with acetic acid, and the dye composition is heated to 80° C. by a heating rate of 3° C./min for 20 minutes.
6. Water wash: the dyed elastic fabric is washed with water to remove excess dye for about 3 minutes, preferably until no pigment visible to the naked eye dissolves.
7. Soap wash: 2.0 g/L of soaping agent is added to the dye composition, and heated to 50° C. by a heating rate of 3° C./min for 20 minutes.
8. Water wash: the dyed elastic fabric is washed with water to remove excess dye about 3 minutes, preferably until no pigment visible to the naked eye dissolves.
9. Finishing: the washed elastic fabric is dehydrated, dried, and ironed.

Embodiments 2-4

The detailed steps are the same as those described in Embodiment 1. Further, in Embodiments 2-4, the elastic fabric used is the same as that in Embodiment 1, with different concentrations of the ion modifier.

Comparative Embodiment 1

The elastic fabric is the same as that in Embodiment 1, but without the ion modifier.

Experiment 1

The dyed elastic fabric of the Embodiments 1-4 and the Comparative Embodiment 1 were tested under the international standards ISO 105 C06 B2S, ISO 105 X12, and ISO 105 E01, the washing fastness, water resistance, sweat fastness and rubbing fastness results are in Table 1 below.

| | | ion modifier concentration | | | | |
|---|---|---|---|---|---|---|
| Project | | Comparative Embodiment 1 0 wt. % | Embodiment 1 0.15 wt. % | Embodiment 2 0.30 wt. % | Embodiment 3 0.60 wt. % | Embodiment 4 1.00 wt. % |
| Washing | wool | 4-5 | 4-5 | 4-5 | 4-5 | 4-5 |
| color | Acrylic | 4-5 | 4-5 | 4-5 | 4-5 | 4-5 |
| fastness | Tedron | 4-5 | 4-5 | 4-5 | 4-5 | 4-5 |
| | nylon | 4-5 | 4-5 | 4-5 | 4-5 | 4-5 |
| | cotton | 4 | 4 | 4 | 4 | 4 |
| | acetic acid | 4-5 | 4-5 | 4-5 | 4-5 | 4-5 |
| Water | wool | 4-5 | 4-5 | 4-5 | 4-5 | 4-5 |
| color | Acrylic | 4-5 | 4-5 | 4-5 | 4-5 | 4-5 |
| fastness | Tedron | 4-5 | 4-5 | 4-5 | 4-5 | 4-5 |
| | nylon | 4-5 | 4-5 | 4-5 | 4-5 | 4-5 |
| | cotton | 4-5 | 4-5 | 4-5 | 4-5 | 4-5 |
| | acetic acid | 4-5 | 4-5 | 4-5 | 4-5 | 4-5 |
| Acid | wool | 4-5 | 4-5 | 4-5 | 4-5 | 4-5 |
| Perspiration | Acrylic | 4-5 | 4-5 | 4-5 | 4-5 | 4-5 |
| color | Tedron | 4-5 | 4-5 | 4-5 | 4-5 | 4-5 |
| fastness | nylon | 4-5 | 4-5 | 4-5 | 4-5 | 4-5 |
| | cotton | 4-5 | 4-5 | 4-5 | 4-5 | 4-5 |
| | acetic acid | 4-5 | 4-5 | 4-5 | 4-5 | 4-5 |

-continued

| Project | | ion modifier concentration | | | | |
|---|---|---|---|---|---|---|
| | | Comparative Embodiment 1 0 wt. % | Embodiment 1 0.15 wt. % | Embodiment 2 0.30 wt. % | Embodiment 3 0.60 wt. % | Embodiment 4 1.00 wt. % |
| Alkali | wool | 4-5 | 4-5 | 4-5 | 4-5 | 4-5 |
| Perspiration | Acrylic | 4-5 | 4-5 | 4-5 | 4-5 | 4-5 |
| color fastness | Tedron | 4-5 | 4-5 | 4-5 | 4-5 | 4-5 |
| | nylon | 4-5 | 4-5 | 4-5 | 4-5 | 4-5 |
| | cotton | 3-4 | 4 | 4 | 4 | 4 |
| | acetic acid | 4-5 | 4-5 | 4-5 | 4-5 | 4-5 |
| rubbing color | dry | 4-5 | 4-5 | 4-5 | 4-5 | 4-5 |
| fastness | wet | 4-5 | 4-5 | 4-5 | 4-5 | 4-5 |

Experiment 2

Figure 5A:
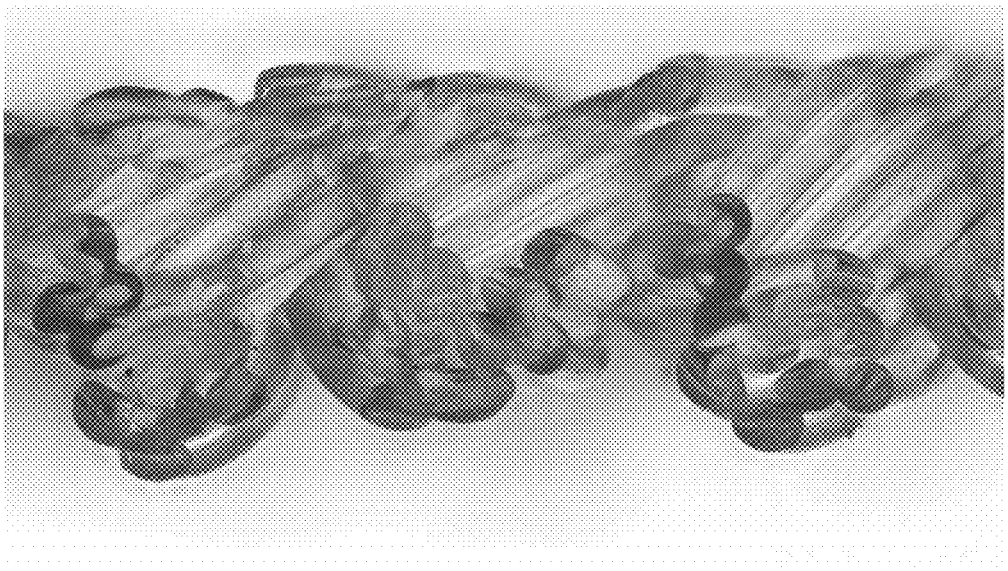
FIG. 5A is a schematic view of the structure of a dyed elastic fabric without an ion modifier in the dye composition.
Figure 5B:
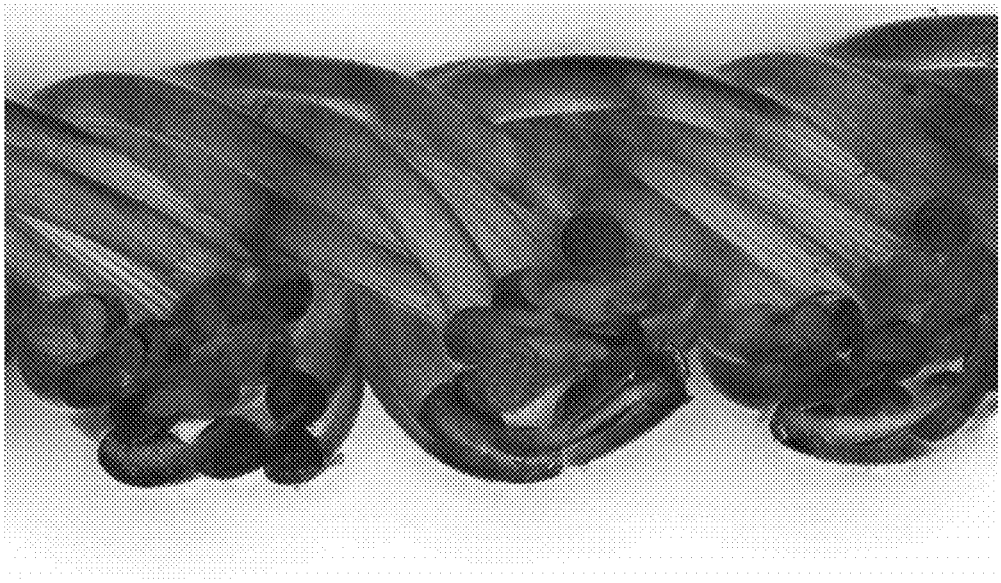
FIG. 5B is a schematic view of the structure of a dyed elastic fabric with a 1% ion modifier in the dye composition.

An elastic fabric containing 100 wt. % of elastic fiber was dyed according to the steps of Embodiment 1, then the dyed color ratio was observed by a laser microscope. As shown in FIG. 5A and FIG. 5B, in which FIG. 5A is an elastic fabric without any ion modifier, FIG. 5B is the elastic fabric with the 1% ion modifier in the dye composition. FIG. 5B with the 1% ion modifier shows significantly improved dyed color ratio compared to FIG. 5A without any ion modifier.

In conclusion, one of the beneficial effects of the present disclosure is that the dyeing method and the dye composition for an elastic fabric provided by the present disclosure has technical features of "the elastic fiber has a first ion by contacting the ion modifier" and "the first ion of the elastic fiber and the second ion of the dye together form an iconic bonding", so that, the first charge ion of the elastic fiber and the second ion of the dye produce a strong ionic bond with strong bonding force. In comparison to the conventional way, the present disclosure improves the way of dyeing, further maintaining a dyeing stability, and ensures a color fastness at an optimal level, and resistances to washing, water, sweat and rubbing.

Furthermore, the dye composition of the present disclosure includes the ion modifier and the dye D, the elastic fiber 11 of the elastic fabric F produces the first charge by contacting the ion modifier, and the first ion has a first charge, and the second ion of the dye D has the second charge opposite to the first charge. Therefore, by the principle of positive charge and negative charge attraction, the first charge and the second ion produce a strong ionic bond with strong bonding force. Through the ionic bond with high bonding force, the dye D can be effectively attached to the elastic fiber, further achieving the effect of dyeing the elastic fiber. In comparison with the conventional method, the dyeing method for the elastic fabric of the present disclosure can effectively improve a dyeing degree, thereby saving water used in a multi-washing procedure in a subsequent washing process, further achieving an effect of environmental protection and a lower cost. The first ion of the elastic fiber and the second ion of the dye together form an iconic bonding. Thereby, the present disclosure improves the way of dyeing elastic fiber, which alleviates the barrie and stripe caused by traditional way of polluting elastic fiber. It also ensures Color Fastness to Water, Color Fastness to Washing, Color Fastness to Perspiration and Color Fastness to Rubbing at an optimal level.

Moreover, by virtue of the ion modifier of the dye composition of the present disclosure, the modified ions can be simultaneously grafted and the dyeing effect can be achieved by the ions in the dyeing process, without performing an additional pretreatment process for the elastic fabric F, so that the dyeing effect can be simply improved, whilst not drastically changing the original process.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A dyeing method for an elastic fabric, comprising:

(a) providing an elastic fabric including an elastic fiber; and (b) immersing the elastic fabric in a dye composition, the dye composition including an ion modifier and a dye, so that the elastic fiber of the elastic fabric contacts with the ion modifier and the dye;

wherein, the elastic fiber has a first ion by contacting the ion modifier, the first ion has a first charge, the dye has a second ion, the second ion has a second charge opposite to the first charge, and the first ion of the elastic fiber and the second ion of the dye together form an ionic bonding to obtain a dyed elastic fabric;

wherein the ion modifier includes an ionizable terminal group, and the ionizable terminal group is selected from the group consisting of: $—SO^{3-}$, $—HPO^{3-}$, $—OPO_3^{2-}$, $—PO_3^{2-}$, $—NR^{3+}$, $PR^{3+}$ and a combination thereof; wherein, R represents a substituted or unsubstituted aryl group or a substituted or unsubstituted alkyl group;

wherein the dye includes a compound represented by the following chemical formula:

A-B;

wherein A is selected from the group consisting of: anthraquinone dye, naphthoquinone dye, pyrenequinone dye, triphenylmethane dye, xanthene dye, metal phthalocyanine dye, stilbene dye, nitroso dye, oxazine dye, dioxazine dye, pyrazolone dye and a combination thereof;

wherein B is a $SO_3H$ group.

2. The dyeing method for an elastic fabric according to claim 1, wherein the first charge is a positive charge, and the second charge is a negative charge.

3. The dyeing method for an elastic fabric according to claim 1, wherein the first charge is a negative charge, and the second charge is a positive charge.

4. The dyeing method for an elastic fabric according to claim 1, wherein the elastic fiber is natural rubber, synthetic rubber, or a combination thereof.

5. The dyeing method for an elastic fabric according to claim 1, wherein the dye composition has a pH value between pH4 and pH6.

6. The dyeing method for an elastic fabric according to claim 1, wherein step (b) further includes: raising the temperature of the dye composition from room temperature to a dyeing temperature of 85 to 115° C. by a heating rate of 0.5 to 1.5° C./min, and maintaining the dyeing temperature for 20 to 60 minutes; and then decreasing the temperature of the dye composition to a temperature between 70 to 60° C. by a cooling rate from 1 to 1.5° C./min.

7. The dyeing method for an elastic fabric according to claim 1, further including step (c): washing the dyed elastic fabric for 3 to 5 minutes at a temperature between 45 to 50° C.

* * * * *